US011518661B2

(12) United States Patent
Bigham

(10) Patent No.: US 11,518,661 B2
(45) Date of Patent: Dec. 6, 2022

(54) COVER LIFT AND MOVE APPARATUS

(71) Applicant: Bigham Easy Lift, LLC, North Mankato, MN (US)

(72) Inventor: Vernon Bigham, Robbinsdale, MN (US)

(73) Assignee: BIGHAM EASY LIFT, LLC, North Mankato, MN (US)

( * ) Notice: Subject to any disclaimer, the term of this patent is extended or adjusted under 35 U.S.C. 154(b) by 108 days.

(21) Appl. No.: 16/736,639

(22) Filed: Jan. 7, 2020

(65) Prior Publication Data

US 2021/0206613 A1 Jul. 8, 2021

(51) Int. Cl.

| | |
|---|---|
| ***B66F 19/00*** | (2006.01) |
| ***B66C 1/06*** | (2006.01) |
| ***E02D 29/14*** | (2006.01) |

(52) U.S. Cl.

CPC ..... *B66F 19/005* (2013.01); *B66C 1/06* (2013.01); *E02D 29/1445* (2013.01)

(58) Field of Classification Search

CPC . B66F 19/005; B66F 3/12; B66C 1/06; E02D 29/1445

See application file for complete search history.

(56) References Cited

U.S. PATENT DOCUMENTS 3,861,097 A * 1/1975 Patterson ..... E02D 5/805 52/160
4,712,762 A * 12/1987 Liedle ..... F16M 11/247 248/156
4,746,098 A 5/1988 Abarotin
4,826,388 A 5/1989 Golding
4,928,927 A 5/1990 Fredrick et al.
5,035,336 A * 7/1991 Schmitz ..... B66F 19/005 212/343
5,458,435 A * 10/1995 Kohno ..... B66F 19/005 404/25
5,674,045 A * 10/1997 Eckloff ..... B66F 19/005 254/100
5,993,106 A * 11/1999 Huang ..... B66F 3/12 404/26
6,176,469 B1 1/2001 Bigham
6,520,482 B1 2/2003 Bigham
6,676,111 B2 1/2004 Bigham
7,731,451 B2 6/2010 Roberts
8,043,041 B1 * 10/2011 Neeley ..... B66F 19/005 254/133 R
9,290,370 B1 5/2016 Panio et al.
9,815,675 B1 * 11/2017 Gray ..... B66F 19/005
(Continued)

*Primary Examiner* — Lee A Holly
(74) *Attorney, Agent, or Firm* — Westman, Champlin & Koehler, P.A.; Z. Peter Sawicki; Amanda M. Prose

(57) ABSTRACT

A lifting and moving device, and a method of using the device comprising a frame having a first ground engaging end with at least one wheel for providing a movable first ground engagement and a second ground engaging end with a pointed end for providing a fixed second ground engagement for the frame. A lifting and moving support extending between the first and second ground engaging ends is adjustable in length for providing one or more distances between the first ground engaging end and the second ground engaging end. A lifting device is retractable from a position on the support and the frame is movable about a pivot point provided by the second ground engaging end.

5 Claims, 4 Drawing Sheets

(56) References Cited

U.S. PATENT DOCUMENTS

| | | | | |
|---|---|---|---|---|
| 10,737,924 | B1 * | 8/2020 | Crowell | B66F 19/005 |
| 2008/0159810 | A1 * | 7/2008 | Myers | B66F 19/005<br>404/83 |
| 2014/0301819 | A1 * | 10/2014 | Panio | B66F 19/005<br>414/800 |
| 2016/0368748 | A1 * | 12/2016 | Doherty | E02D 29/1418 |

* cited by examiner

COVER LIFT AND MOVE APPARATUS

BACKGROUND

Manholes in streets provide access to various underground utilities. Manhole covers are generally iron plates sunk into streets and sidewalks to keep passers-by from falling into manholes. The cover must be a minimum of 22 in (56 cm) in diameter, but can be as much as 60 in (1.5 m) in diameter. The average cover weighs between 250 and 300 lbs however; larger covers may weigh up to 400 lbs or more. The covers must be secure enough to prevent movement of the cover when a vehicle drives over the cover. These covers must be moved to allow a worker to access the underground utility and be replaced correctly to ensure safety above ground.

SUMMARY

An aspect of the present disclosure relates to a frame having a first ground engaging end with a single contact point for providing a stationary engagement with a ground surface at a first location and a second ground engaging end having at least one wheeled contact point for moveably engaging with the ground surface at a second location spaced apart from the first location. The frame also has an adjustable support extending therebetween for selecting a spacing between the first and second locations and wherein the adjustable support retains a vertically adjustable connection mechanism for coupling to an object for lifting and moving the object. The single contact point provides a pivot point for moving the second ground engaging end along an arcuate path in reciprocal directions, the arcuate path based at least in part on the selected spacing between the first and second locations.

The second ground engaging end comprises two spaced apart wheeled contact points. Each wheeled contact point has a caster and a wheel for moveably engaging the second end with the ground surface.

The first and second ground engaging ends are substantially vertical arms extending downwardly from a connection with the adjustable support extending substantially horizontally therebetween.

The substantially vertical arms are adjustable such that a height of the first and the second ground engaging ends is individually adjustable to the same or different heights for use over uneven or inclined surfaces.

The adjustable support has a sliding mechanism or a telescoping arm for independently increasing and decreasing the lateral spacing between the first and second ground engaging ends.

The first ground engaging end comprises a length extending from connection with the adjustable support and wherein the length terminates in a tapered end having a terminal point for engaging with the ground surface wherein the terminal point has a cross-sectional dimension less than a cross-sectional dimension of the length. For example, the length portion has a cross-sectional dimension such as a width or diameter that is at least two times, three times or four times greater than the cross-sectional dimension such as a width or diameter of the terminal point for engaging the ground surface.

The connection mechanism is a magnet configured for magnetically coupling to the object for lifting and moving the object. The object is a manhole cover, a street or sidewalk grate, or a metal structure positioned over an opening in a ground surface.

The connection mechanism is vertically moveable via a pulley system or a winch system operably coupled to the support arm.

Another aspect of the present disclosure relates to a lifting and moving device having a frame with a first ground engaging end comprising at least one wheel for providing a movable first ground engagement and a second ground engaging end comprising a pointed end for providing a fixed second ground engagement. The device also has a lifting and moving support extending between the first and second ground engaging ends, and wherein a length of the lifting and moving support is adjustable for providing one or more distances between the first ground engaging end and the second ground engaging ends.

The second ground engaging end provides a pivot point for moving the first ground engaging end in reciprocal directions along an arcuate path based on a selected one or more distances between the first ground engaging end and the second ground engaging end. The first ground engaging end and second ground engaging end are independently adjustable for providing one or more distances between the lifting and moving support and a ground surface.

A magnetic device for coupling to an object to be lifted and moved is supported on the lifting and moving support and is configured to extend therefrom for coupling to the object and retract thereto for lifting and moving the object.

Another aspect of the present disclosure relates to a method of lifting, moving, and replacing a manhole cover, street or sidewalk grate, or other structure positioned over an opening in a ground surface. The method includes positioning a device over the manhole cover, street or sidewalk grate or other structure such that the manhole cover, street or sidewalk grate or other structure is below the device and positioned between a first ground engaging end and a second ground engaging end of the device. Further, coupling the manhole cover, street or sidewalk grate or other structure to a connection mechanism positioned on a support extending between the first and second ground engaging end and raising the manhole cover, street or sidewalk grate or other structure to lift it off a first ground surface allows for picking up the object. Moving the second ground engaging end along an accurate path to move the manhole cover, street or sidewalk grate or other structure to a position over a second ground surface spaced apart from the first ground surface and supporting first ground engaging end in a fixed location via a pointed single contact having a surface area less than about one square inch or a circumference less than about 3.14 inches. This provides a pivot point for moving the second ground engaging end and enabling exact replacement of the manhole cover, street or sidewalk grate or other structure to the first ground surface without adjusting the first or second ends of the device or the spacing therebetween allows for precision in moving and replacing the manhole cover, street or sidewalk grate or other structure automatically. The pointed single contact can have a surface area less than about one-half square inch or a circumference less than about 1.57 inches.

Using the device on uneven or different surfaces can be achieved by adjusting a height of one or both of the first or second ground engaging ends. Adjusting the spacing between the first and second ends by selecting a length of the cross support based in part on the size of the manhole cover, street or sidewalk grate, or other structure further allows for use in connection with various sized or shaped covers or grates.

DETAILED DESCRIPTION

Figure 1:
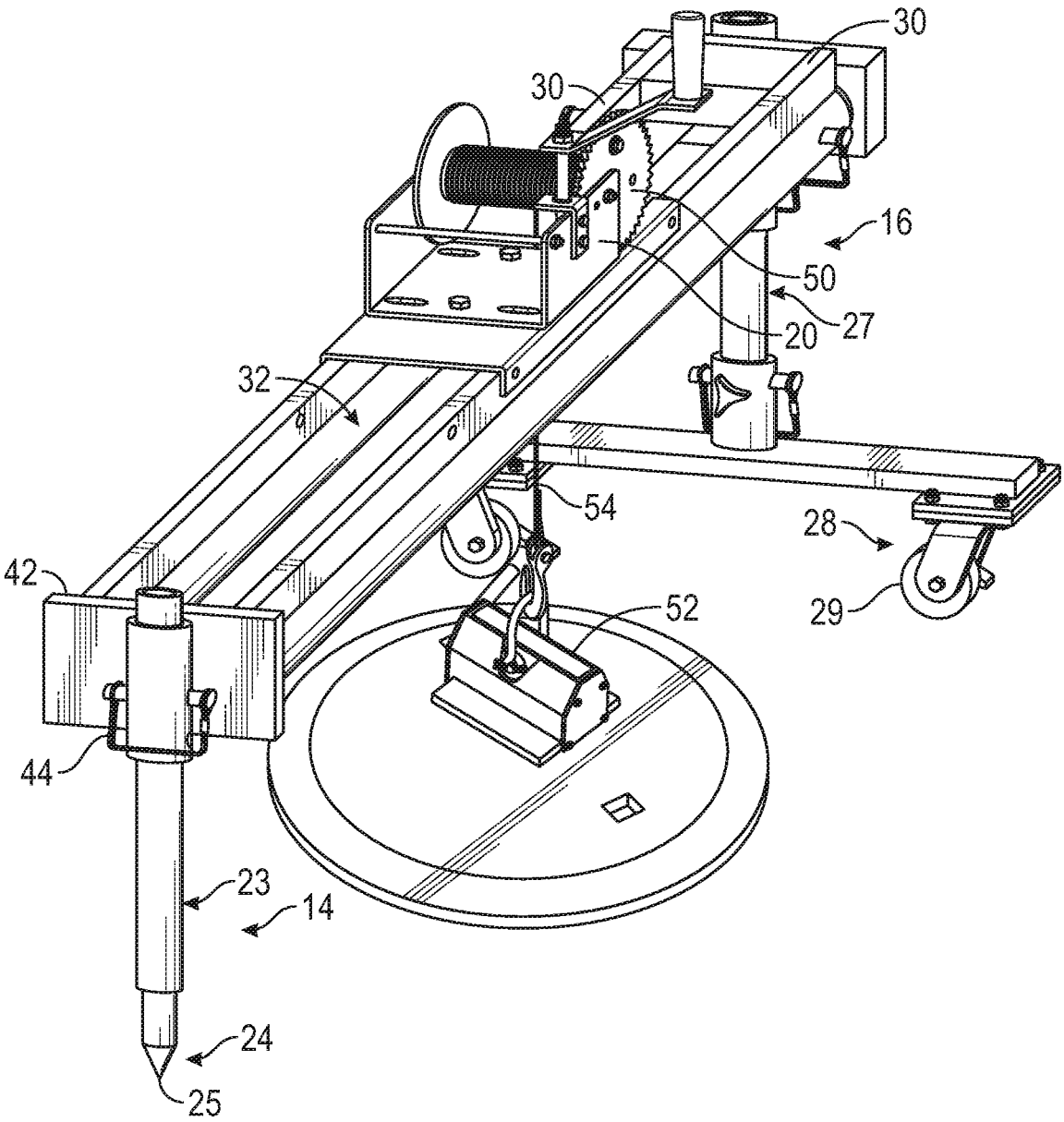
FIG. 1 is a perspective view of a lifting and moving device as disclosed herein.
Figure 2:
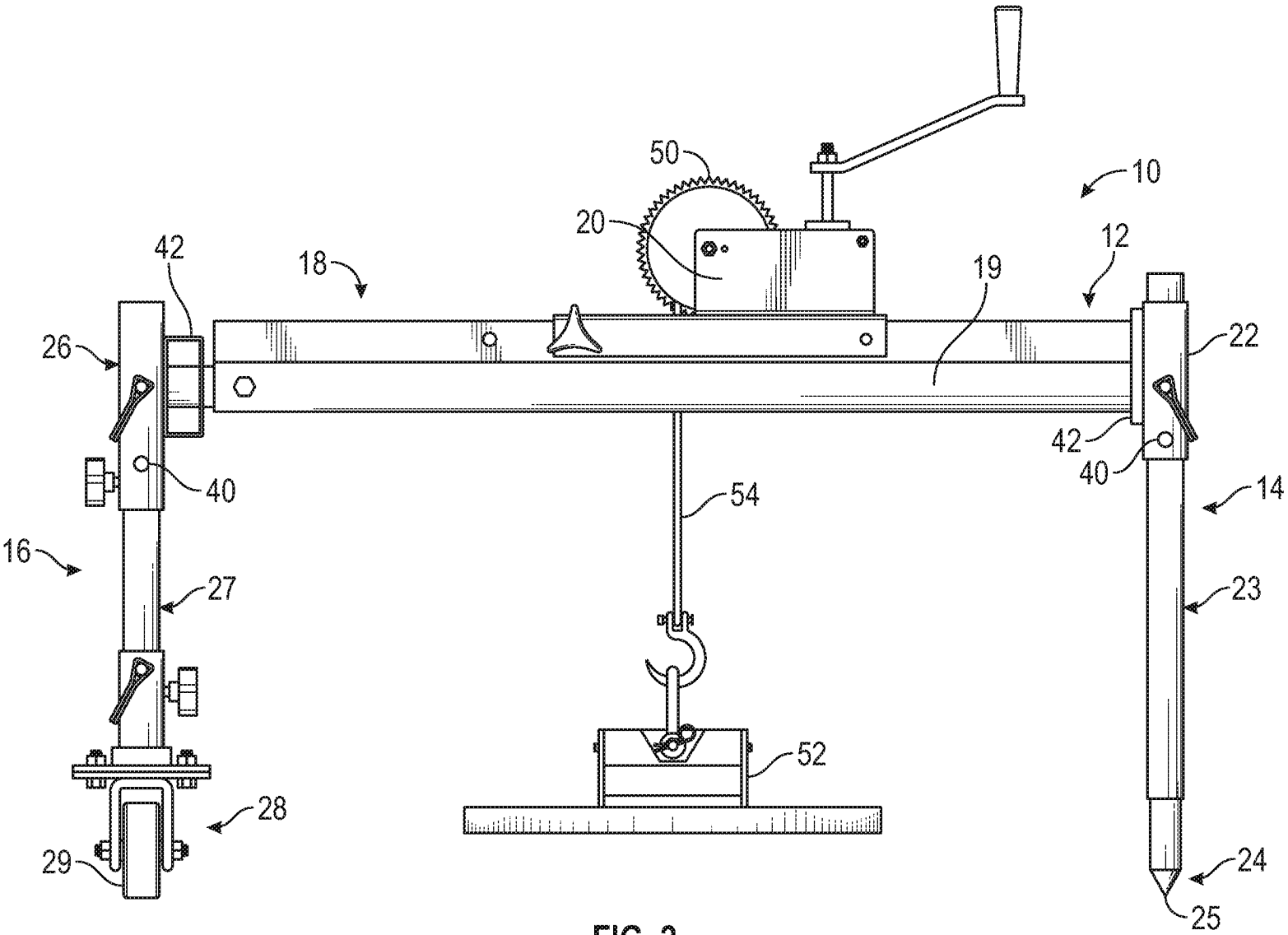
FIG. 2 is a side view of the lifting and moving device.

A protractor motion lift and moving device is a device configured for easy lifting, moving and precise replacing of an object such as a manhole cover, landscaping drain grate, street grate or other generally heavy structure placed on a ground surface to cover an opening for safety of those above ground. Further, the device described herein may be used to move other objects laid on or in ground for purposes of safety and/or aesthetic. The device allows for easy lifting and moving of an object, such as a steel object and precise easy replacement of the object to substantially the exact location from which it was picked up.

The device has a frame that provides a connector for attaching to the object for lifting the object. The frame is also configured with at least one ground engaging wheel for moving at least one end or side of the frame. The frame is moveable for purposes of moving the lifted object, where for example, the object is a cover that must be moved to allow for access to an opening. The frame is then moveable for purposes of replacing the cover over the opening. A stationary end of the frame is configured to ensure with precision that the cover is easily moved back to substantially the exact location from which it was lifted for easy replacement over the opening.

The frame comprises one or more adjustable lengths such that the device is adjustable for use with various sized objects. For example, one or both ground engaging ends of the frame are vertically adjustable such that the height of the frame with respect to a ground surface is adjustable. Where both ground engaging ends are adjustable, the ground engaging ends are independently adjustable. Thus, the frame can be leveled on an uneven surface or easily lift an object on an inclined surface. A generally horizontal support arm extends between the ground engaging ends and supports the connector for coupling to the object for lifting and moving. This support arm may also be adjustable along its length, thus allowing a user to select the distance between the ground engaging ends and to accommodate objects of different sizes such as manhole covers of different diameters.

The connector is a mechanism configured to couple to the object and may be one of a chain and hook combination for engaging with an opening in the object or may be a magnet for magnetically coupling to a surface of the object. The connector mechanism is coupled to the support arm via a mechanism for lifting and lowering the connector mechanism.

The frame is then positionable over the object with the position of the one or more adjustable lengths selected for purposes of providing the connector over the object and the ground engaging ends spaced apart from sides of the object such that the frame provides clearance for lifting and moving the object. The connector is lowerable into contact with the object, coupled to the object, and raised to lift the object off the ground surface. The wheeled end of the frame is then moved along a path which is fixed by way of a stationary ground engaging end of the frame which is removably secured to the ground surface. The frame is thus moved away from the opening or ground where the object was lifted from, providing a clearance and unobstructed access to the opening. For replacement of the object, the wheeled end of the frame is then moved in a reciprocal direction thus bringing the object back to where it was removed from and allowing for lowering of the object back to substantially the exact spot from which it was removed.

One embodiment of a protractor motion lift and moving device is illustrated generally at 10 in FIGS. 1-6. The lift and moving device 10 comprises a frame 12 having a first side support 14 and a second side support 16 with a cross support 18 extending therebetween. An object lifter 20 is supported on the cross support 18 and configured to be lowered and raised from a height on or near the cross support 18.

The first side support 14 has a cross support coupling end 22 and a ground surface engaging end 24 with a length 23 extending therebetween. The length 23 may be adjustable. The second side support 16 has a cross support coupling end 26 and a ground surface engaging end 28 with a length 27 extending therebetween. The length 27 may be adjustable. The lengths 23 and 27 may be independently adjustable.

In the embodiment illustrated, each coupling end 22 and 26 comprises a sleeve 40 which is secured to ends of the cross support 18 which terminate in a mounting plate 42. Thus, the mounting plate 42 is vertical plate 42 for operably securing the cross support 18 to each of the side supports 14 and 16. The sleeves 40 are vertically secured to the mounting plate 42 and thus allow for the respective side supports 14 and 16 to move within said tube. Thus, in the embodiment illustrated, the lengths 23 and 27 of each of the side supports 14 and 16 are movable so as to adjust the distance between the cross support 18 and the ground surface and then secured by one or more apertures 15 along upper ends of each of lengths 23 and 27. A position of the side supports 14 and 16 is selected by way of aligning one of the one more aperture 15 with an aperture 17 on the respective sleeve 40 and inserting a locking pin 44 through the apertures 17 and 15 thus securing the side supports 14 and 16 at a selected location with respect to the cross support 18. Alternative mechanisms for adjusting the length 23 and 27 of the side supports 14 or 16 extending between the cross support 18 and respective ground engaging ends 24 and 28 can include telescoping lengths, for example.

Figure 3:
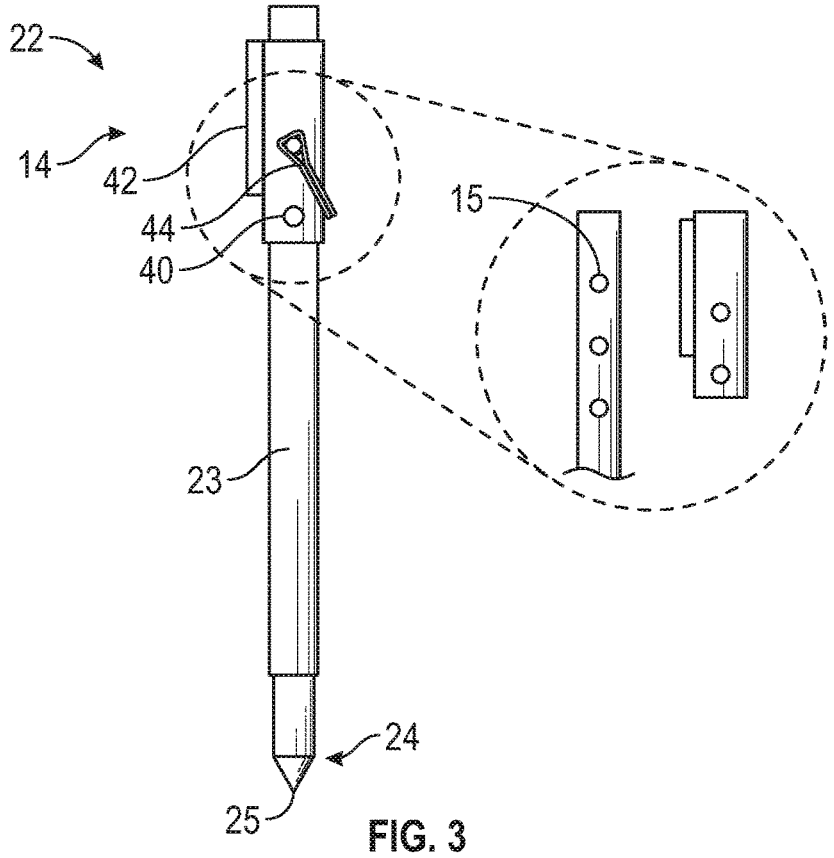
FIG. 3 is a side view of a first ground engaging end of the device.
Figure 4:
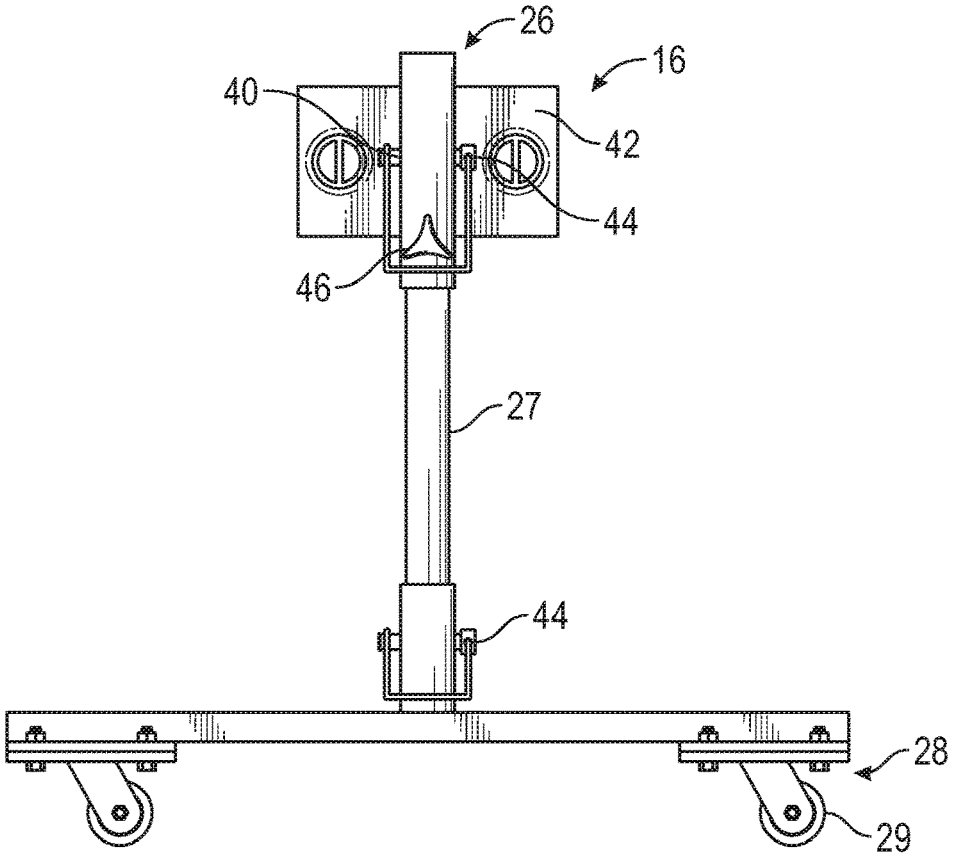
FIG. 4 is a side view of a second ground engaging end of the device.
Figure 5:
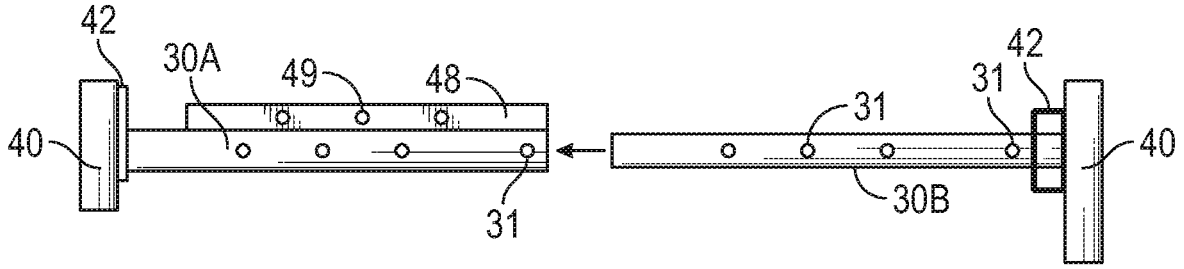
FIG. 5 is a side view of a cross support section of the device.

In further detail, the first side support 14 terminates in the ground engaging end 24 which comprises a fixed connection point for securing the frame 12 on the ground surface. The fixed connection point refers to a terminal end of the side support 14 such that the first ground engaging end 24 provides a stationary ground engagement. As illustrated in FIG. 3, the first ground engaging end 24 is a pointed end 25 wherein the end which contacts the ground surface is an apex as a length of the ground engaging end 24 tapers to the pointed end 25. This pointed end 25 provides a fixed connection with the ground surface which provides a pivot point for movement of the second side support 16 ground engaging end 28. The pointed end 25 has a single point of contact with the ground surface which allows the device to be stable at the first ground engaging end and fixed in place when lifting or lowering an object supported by the frame and when moving the second ground engaging end. The pointed end 25 also allows for exact replacement of the object moved by moving of the ground engaging end only.

The second side support 16 terminates in the ground engaging end 28 which comprises a movable connection point for movably supporting the frame 12 on the ground surface. The moveable connection point refers to a wheeled end 29 of the side support 16 such that the wheeled end 29 provides a moveable connection point for the frame 12. The frame 12 is thus movable along a path defined in part by the length of the cross support 18 wherein the first ground engaging end 24 provides a fixed connection point or pivot point for moving the second ground engaging 28 end along an arcuate perimeter, with the pivot point in the center and the cross support 18 adjustably providing a selected radius of the perimeter path.

The second ground engaging end 28 comprises a wheeled end 29 where a length of the ground engaging end 28 terminates in a coupling for supporting one or more casters for operably connecting one or more wheels to the second ground engaging end 28. This allows the second ground engaging end 28 to move in reciprocal directions along any path, including the arcuate perimeter path described above.

The cross support 18 extends from connection with the cross support coupling ends 22 and 26 of each of side supports 14 and 16. The cross support 18 has a length 19 that is also adjustable. As illustrated in FIGS. 1-5, the cross support 18 may comprise two parallel rails 30 with a space 32 between the rails and substantially coextensive with the length 19 of the rails 30.

The cross support 18 is adjustable along its length 19 which allows the frame 12 to be used with objects of various sizes including but not limited to manhole covers of different diameters and street or sidewalk grates of different dimensions. The length 19 provides a radius to the perimeter along which the second ground engaging end 26 which can move in order to reposition the manhole cover or street or sidewalk grate and replace it to its original position with precision. Even though the length 19 is adjusted for a manhole cover or street or sidewalk grate of different diameters or different dimensions, the manhole cover or street or sidewalk grate is returnable to its original position over the hole or opening without the need for manual adjustment. This feature reduces injuries of workers who would otherwise have to use their hands and backs to move/adjust the manhole cover or street or sidewalk grate into its final position. Such manhole covers or street or sidewalk grates may weigh up to 600 or more pounds which pose significant safety issues if the manhole cover or street or sidewalk grate has to be adjusted manually to its final resting position.

In the embodiment illustrated in the figures, the length 19 of the cross support 18 is adjustable by way of each rail 30 comprising an outer rail 30A which acts as a sleeve for receiving a corresponding inner rail 30B at least partially therein such that each inner rail 30B is slidable into and out of the outer rail 30A. To stably and/or easily achieve a length 19 adjustment, a first end of outer rail 30A terminates in one coupling end 22 and 26 such that the opposing end of outer rail 30A is open for receiving a first end of inner rail 30B therein. An opposing second end of inner rail 30B then terminates in the opposing coupling end 22 or 26. Thus, the frame 12 can be said to disassemble into at least two parts such as two main parts, where a first main part comprises side support 14 coupled to one end of outer rails 30A and a second main part comprises side support 16 coupled to one end of inner rails 30B. The frame 12 is thus assembled by way of inserting the opposing end of inner rails 30B into the open end of outer rails 30A. The length 19 of the cross support 18 then can be selected based on the location of the inner rails 30B with respect to the outer rails 30A. The length selected can be secured by a locking mechanism such as a locking pin inserted through aligned corresponding apertures on each of the inner 30A and outer rails 30B.

Each outer rail 30A further comprises a track 48 protruding upwardly from the outer rail 30A along at least a portion of the length of the outer rail 30A. Each track 48 further comprises one or more apertures 49 therein. The tracks 48 provide a mechanism for supporting an object lifter 20 on the cross support 18.

In the embodiment illustrated the object lifter 20 comprises a winch 50 which raises and lowers a pickup device 52. The winch 50 comprises a base configured to rest on the track 48 for allowing the winch 50 to be positioned at a selected position on the cross-support 18 and adjusted based on the length 19 of the cross support 18 selected. In one embodiment, the track 48 allows the object lifter 20 to be slid along the cross support 18 for positioning and locked in place with one or more locking pins configured for insertion between an aligned aperture on the object lifter 20 and through the track 48. Further, the winch 50 can be positioned such that a winch line 54 which extends through the space 32 between the rails 30 of the cross support 18 for connecting to the pickup device 52 and for raising and lowering the pickup device 52 with respect to cross support 18. Moreover, this positioning allows the frame 12 to stably lift and lower as well as transport a heavy object coupled to the pickup device wherein the heavy object may weigh as much as 250 lbs, 300 lbs, 400 lbs, or greater.

The pickup device 52 may comprise a magnetic clamp for magnetically coupling to a surface of the object for lifting it, or a chain and hook assembly for hooking to an opening on the object. A lifting magnet capable of lifting a manhole lid or cover up to 660 lbs or more may be secured to the winch line 54. The magnet is clamped to the magnetic object for lifting and unclamped for removal without any special tools or pry bars. The magnet can be an electromagnet. For example, telephone sidewalk landscaping includes large grates for drainage and also for protecting the root of trees or other plants, which can be lifted and moved by various means in addition to a heavy duty magnet. For example, a hook may catch onto an opening in such a grate and lift the grate for moving the grate to allow access for planting, or repair or maintenance.

The frame 12 may be a tubular framework comprised of one or more parts. In the embodiment illustrated the frame 12 comprises a plurality of adjustable components for assembly including an adjustable length cross support 18 as well as adjustable side supports 14 and 16 where the height of the cross support 18 over a ground surface can be adjusted and where the side supports 14 and 16 are independently adjustable to allow the frame 12 to be leveled over an inclined surface for example. Further, the side supports 14 and 16 may be removable from connection with the cross support 18 such that the device 10 can be easily disassembled and/or assembled for easy storage and transport. The frame 12 may be constructed from aluminum, titanium, steel, like metals, alloys or combinations thereof.

Figure 6:
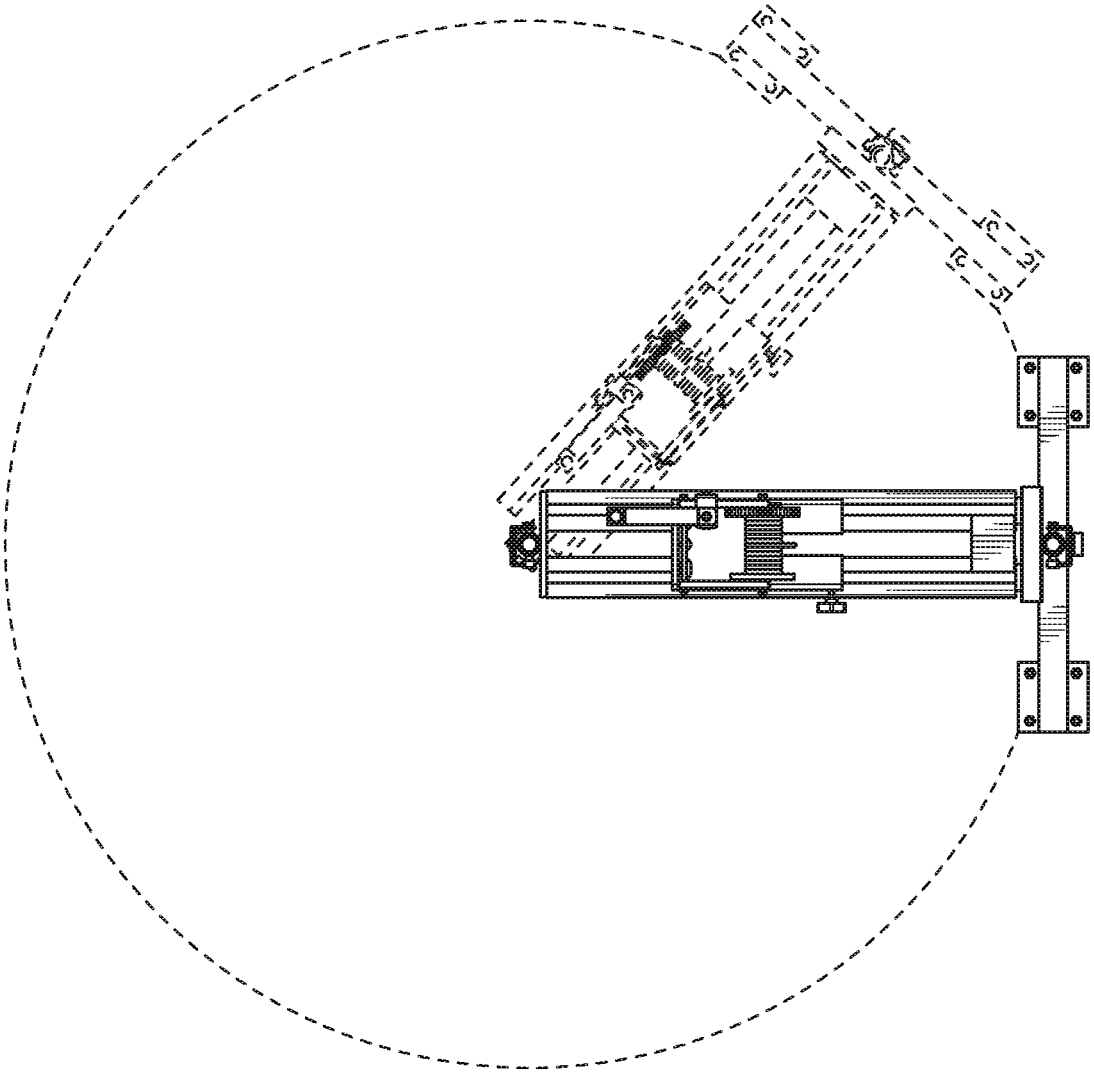
FIG. 6 is a perspective view of the movement of the lifting and moving device.

Referring to FIG. 6, one embodiment of using the protractor motion lift and moving device 10 for an object such as a manhole cover includes positioning the assembled device 10 over the manhole cover. The height of the cross support 18 is selected by way of selecting a position of each side support 14 and 16 with respect to the cross support 18 and the length of the cross support 18 is also selected by positioning the inner rail 30B with respect to the outer rail 30A. Each adjustable mechanism is locked in place once selected. The lifting device 20 is positioned on the rails 30. The pickup device 54 is then lowered into contact with the object and coupled to the object. Where the pickup device is a magnet, the magnet is put into contact with the surface of the object such as a manhole cover and the magnet clamped to the cover. The first side support 14 is engaged with a single point on the ground surface via connection and engagement of the point end 25 with the ground surface. The second side support 16 is then moved along a circular path via engagement of the wheels of the second ground engaging end 26 with the ground surface from a lift location to a second location. Thus, the manhole cover is easily lifted and moved away from the opening it covers. When ready for replacement, the second ground engaging end 26 is moved back to the lift location along the circular path to replace the manhole cover in substantially the exact location from which it was lifted without requiring any repositioning of the frame 12.

Although the present disclosure has been described with reference to preferred embodiments, workers skilled in the art will recognize that changes may be made in form and detail without departing from the spirit and scope of the disclosure.

The invention claimed is:

1. A lifting and moving device comprising:

a frame comprising:

a first ground engaging end comprising at least one wheel for providing a movable first ground engagement;

a second ground engaging end comprising a pointed end for providing a fixed second ground surface engagement with a pointed single contact having a surface area less than one square inch or a circumference less than 3.14 inches; and a lifting and moving support arm extending a length between the first and second ground engaging ends, and wherein the length of the lifting and moving support arm is adjustable for providing one or more distances between the first ground engaging end and the second ground engaging ends, and wherein a height of the first ground engaging end and a height of the second ground engaging end are independently adjustable, such that the frame is adjustable for providing one or more distances between the lifting and moving support arm and the ground.

2. The lifting and moving device of claim 1 wherein the second ground engaging end provides a pivot point for moving the first ground engaging end in reciprocal directions along an arcuate path based on a selected one or more distances between the first ground engaging end and the second ground engaging end.

3. The lifting and moving device of claim 2 wherein the first ground engaging end and second ground engaging end are independently adjustable for providing one or more distances between the lifting and moving support and a ground surface.

4. The lifting and moving device of claim 2 wherein a magnetic device for coupling to an object to be lifted and moved is supported on the lifting and moving support and is configured to extend therefrom for coupling to the object and retract thereto for lifting and moving the object.

5. The lifting and moving device of claim 1 wherein the frame is provided with a plurality of connection mechanisms such that the first ground engaging end, second ground engaging end and lifting and moving support arm are configured for onsite assembly and disassembly for use and storage.

* * * * *